US005993563A

United States Patent [19]

Strickland et al.

[11] Patent Number: 5,993,563

[45] Date of Patent: Nov. 30, 1999

[54] COMBINATION OF MAIN SCRUBBING MACHINE AND ATTACHMENT SCRUBBING MACHINE

[75] Inventors: Timothy A. Strickland, Raeford; Richard C. Brigman, Aberdeen, both of N.C.; Robert J. O'Hara, Castle Rock, Colo.

[73] Assignee: Windsor Industries, Inc., Englewood, Colo.

[21] Appl. No.: 09/073,042

[22] Filed: May 5, 1998

[51] Int. Cl.[6] ..... B08B 3/04; B08B 5/04; A47L 7/02

[52] U.S. Cl. ..... 134/21; 15/320; 15/331; 15/377

[58] Field of Search ..... 15/320, 328, 340.1, 15/640.2, 340.3, 340.4, 339, 4, 331, 334, 377; 134/21

[56] References Cited

U.S. PATENT DOCUMENTS 2,789,306 4/1957 Kath ..... 15/331
4,317,252 3/1982 Knowlton ..... 15/320
4,893,375 1/1990 Girman et al. ..... 15/320
5,742,975 4/1998 Knowlton et al. ..... 15/340.3

*Primary Examiner*—Terrence R. Till
*Assistant Examiner*—Theresa T. Snider
*Attorney, Agent, or Firm*—Sheridan Ross P.C.

[57] ABSTRACT

A larger scrubbing machine and a smaller scrubbing machine are provided in combination. The larger scrubbing machine scrubs larger floor areas and the smaller scrubbing machine scrubs smaller floor areas that are typically inaccessible by the larger machine. When the larger machine is being used, the smaller scrubbing machine is attached thereto. When a smaller floor area is to be cleaned, the smaller scrubbing machine is removed from the larger scrubbing machine. The smaller scrubbing machine includes a scrubber assembly and a motor that is powered using an electrical power source located on the larger machine. A spring is operatively connected to this scrubber assembly for ensuring desired contact between the brush bristles and the floor area being cleaned. Two spaced pairs of wheels provide a uniform plane of contact during scrubbing by the scrubber assembly. The smaller scrubbing machine also has a pivotal wand to further facilitate the scrubbing operation, particularly removal of recovered liquid from the floor.

33 Claims, 10 Drawing Sheets

COMBINATION OF MAIN SCRUBBING MACHINE AND ATTACHMENT SCRUBBING MACHINE

FIELD OF THE INVENTION

The present invention relates to a combination of a main scrubbing machine and a supplemental scrubbing machine that is attachable to the main scrubbing machine and accesses smaller floor areas for scrubbing them.

BACKGROUND OF THE INVENTION

When cleaning relatively larger buildings with wide aisles, it is commonplace to utilize a cleaning machine that has a wide scrubbing brush. The wide scrubbing brush is able to clean a large floor area during one pass of the cleaning machine. However, such a large machine has some drawbacks. Because of its size and limited maneuverability, it is not feasible for the wide scrubbing brush to access all areas that need to be cleaned. For example, an essentially dead end aisle is not accessible for cleaning by such a large machine. By the same token, it is not acceptable to simply leave floor areas unscrubbed or uncleaned.

A known solution for ensuring that all areas are cleaned, when using a relatively large scrubbing machine, is to utilize a smaller cleaning machine for the smaller floor areas. The smaller cleaning machine can be carried by the large scrubbing machine. When the floor area that is inaccessible by the larger machine needs to be cleaned, the smaller cleaning machine is detached from the larger machine. After removal and desired positioning, the scrubbing head of the smaller machine is manually operated or manipulated in order to scrub the particular floor area. The cleaning liquid supplied to the scrubbing brush of the smaller cleaning machine is obtained from the larger machine by means of a cleaning liquid hose or the like. Similarly, the recovered liquid is suctioned through the smaller cleaning machine to the larger machine that has a vacuum pump for creating the desired negative pressure. After the smaller floor area is cleaned using this smaller cleaning machine, it is re-attached to the larger cleaning machine, which can then continue with scrubbing a different larger floor area.

Notwithstanding the advancement and availability of cleaning hardware that includes both larger and smaller scrubbing machines, it would be desirable to enhance the capabilities of such a combination. Specifically, it would be advantageous to facilitate the required scrubbing action, while enhancing other important features that such a smaller scrubbing machine should have, including suitable interconnections with the larger machine and proper contact between the squeegee and the floor and the brush bristles and the floor at all times during the scrubbing operations.

SUMMARY OF THE INVENTION

In accordance with the present invention, a combination main scrubbing machine and attachment scrubbing machine is disclosed. The main scrubbing machine is used to clean large floor surface areas while the attachment scrubbing machine is used to clean floor areas that are not readily accessible by the larger main scrubbing machine. The main scrubbing machine can include a rider machine or a walk-behind machine. The attachment scrubbing machine is fastened to and carried by the main scrubbing machine while the main scrubbing machine is cleaning wide, accessible floor surface areas. The main scrubbing machine includes a first or main scrubber assembly connected to the bottom thereof. Cleaning liquid is contained with the main scrubbing machine and is controllably delivered to the first scrubber assembly as the main scrubbing machine is scrubbing the larger floor area. Recovered liquid from the cleaning operation is suctioned into a recovery tank that contains the recovered liquid from the floor area being cleaned. The main scrubbing machine also has a source of electrical power, such as a battery used in powering the first scrubber assembly. In addition to the bottom of the main scrubbing machine, it also has a back or rear section to which the attachment scrubbing machine is removably held. When a smaller floor area is to be cleaned that cannot be properly cleaned by the main scrubbing machine, the main scrubbing machine is stopped and the attachment scrubbing machine is removed therefrom in conjunction with cleaning the smaller floor area. In that regard, the attachment scrubbing machine includes a head assembly and a handle assembly. In one embodiment, the attachment scrubbing machine is stored with the main scrubbing machine as an assembled unit. In another embodiment, the head and handle assemblies are separated from each other when held to the rear section of the main scrubbing machine. The head assembly includes a second or attachment scrubber assembly for scrubbing the smaller floor area. The second scrubber assembly is also electrically powered. A brush motor is supported on a deck of the head assembly, with the motor being housed within a head or cover that is joined to the deck. The brush motor is powered by the same battery or other source of electrical power found with the main scrubbing machine. An electrical cord having current-conducting wires is electrically connectable to the head assembly using mating connectors. That is, when it is desirable to use the attachment scrubbing machine and after it is removed from the main scrubbing machine, the electrical cord is electrically connected at its opposite ends for carrying current from the electrical power source on the main scrubbing machine to the brush motor on the attachment scrubbing machine. A power switch is also operably connected to the head assembly for controlling the turning on/turning off of power to the brush motor. Preferably, the brush motor power switch is foot-activated/deactivated.

The second scrubber assembly of the attachment scrubbing machine is disposed beneath the deck. The second scrubber assembly includes a support member and brush bristles that are connected to and supported by the support member. In the center of the support member, a drive lug is connected to the brush motor shaft so that rotation of the brush motor shaft results in rotation of the second scrubber assembly. Such rotational movement provides a powered scrubbing action. That is, as the brush bristles are caused to move by the electrical power, the lower or free ends of the brush bristles engage the smaller floor surface area for cleaning purposes.

The support member has a generally circular or oval-shaped opening inward of the substantially circumferentially disposed brush bristles. This support member opening receives cleaning liquid that then exits the opening and passes to the floor area being cleaned. Preferably, the cleaning liquid is supplied by the main scrubbing machine. In another embodiment, the cleaning liquid can be provided using a small tank that is part of the attachment scrubbing machine. The second scrubber assembly also has a brush bristle adjustment member or spring for use in controlling the location of the brush bristles relative to the floor or surface area being cleaned. As the free ends of the brush bristles wear due to the scrubbing action, the spring applies a force to the support member that causes the brush bristles to be forced in a direction toward the floor surface.

The head assembly also incorporates four small wheels that are useful in supporting and moving the attachment scrubbing machine. The four wheels provide a controlled plane of contact between the floor and the brush bristles, as well as between the floor and a squeegee subassembly. Consequently, uniformity of contact is always maintained with the four wheels contacting the floor. In a preferred embodiment, the four wheels are comprised of two pairs of wheels. A first pair of wheels is located adjacent to the center of the support member but outwardly therefrom. The second pair of wheels is located at one end of the head assembly, preferably adjacent to the squeegee subassembly.

With regard to supplying the cleaning liquid from the main scrubbing machine, the head assembly also has a cleaning liquid receptacle or inlet provided with the deck. A cleaning liquid supply line is connected thereto at one end. At the opposite end thereof, the cleaning liquid supply line is connected to a cleaning liquid supply pump. This pump is preferably connected to the rear section of the main scrubbing machine and communicates with the source of or a tank for storing the cleaning liquid The squeegee subassembly includes spaced first and second rubber squeegee members that define an area which communicates with a vacuum chamber located at one end of the attachment scrubbing machine. The vacuum chamber communicates with a vacuum conduit that is connectable to the handle assembly. The vacuum chamber and the vacuum conduit carry recovered liquid from the smaller floor area being cleaned, with the first and second rubber squeegee members assisting in the pickup of the recovered liquid.

The handle assembly includes an elongated member or telescopically adjustable wand and a short flexible hose section joined to one end of the wand. The other end of the flexible hose section is removably connected to the vacuum conduit. The opposite end of the wand is connectable to a hose assembly, which is removably attached at one end to a vacuum connector on the main scrubbing machine. The operator engages the wand adjacent its connection to the hose assembly for manipulating the attachment scrubbing machine as the second scrubber assembly is being powered. In addition to the vacuum conduit connection, the handle assembly is also joined to the head assembly by means of a pivotal yoke member. The yoke member enables the handle assembly to be pivoted over the brush motor and the head. Accordingly, access to the recovered liquid is enhanced, since the operator of the attachment scrubbing machine can better position the squeegee subassembly over smaller floor area sections from which recovered liquid is to be suctioned.

When the operator is finished scrubbing a smaller floor area using the attachment scrubbing machine, power to the brush motor is turned off. The attachment scrubbing machine can be re-attached to the main scrubbing machine as a single, assembled unit. In the alternative embodiment, one or more components can be disassembled prior to re-storage on the main scrubbing machine. For example, the electrical cord connector to the head assembly can be disconnected therefrom. The flexible hose section may be removed from the vacuum conduit. The cleaning liquid supply line may be detached from the head assembly. The head assembly can be re-joined to the rear section of the main scrubbing machine, while the handle assembly can be re-attached to the rear section of the main scrubbing machine above the head assembly. As part of one disassembly operation associated with the attachment scrubbing machine, the hose assembly that carries recovered liquid is re-wrapped around a storage rack or other holding device provided on the rear section of the main scrubbing machine.

Based on the foregoing summary, a number of salient aspects of the present invention are readily discerned. A combination main scrubbing machine for cleaning larger floor areas and an attachment scrubbing machine for cleaning smaller floor areas is provided. The attachment scrubbing machine is carried by the main scrubbing machine when the wider floor areas are being cleaned. The attachment scrubbing machine includes a scrubber assembly that is powered, preferably using the same electrical power that is used to drive the scrubber assembly of the main scrubbing machine. The attachment scrubbing machine includes an easily accessible power switch that can be foot activated. Preferably, the cleaning liquid from the main scrubbing machine is delivered to the scrubber assembly of the attachment scrubbing machine so that it contacts the floor within the boundary of the brush bristles. A pivotal wand is provided to augment the recovery of liquid from the floor. The wand length is also telescopically adjustable. In order to control the position of brush bristles relative to the floor, a spring is provided to force the brush bristles in a downward direction. The attachment scrubbing machine also includes two spaced pairs of wheel for support that ensure a controlled plane of contact between the floor and the free ends of the brush bristles, as well as the floor and the rubber squeegees of the squeegee subassembly.

Additional advantages of the present invention will become readily apparent from the following discussion, particularly when taken together with the accompanying drawings.

DETAILED DESCRIPTION

Figure 1:
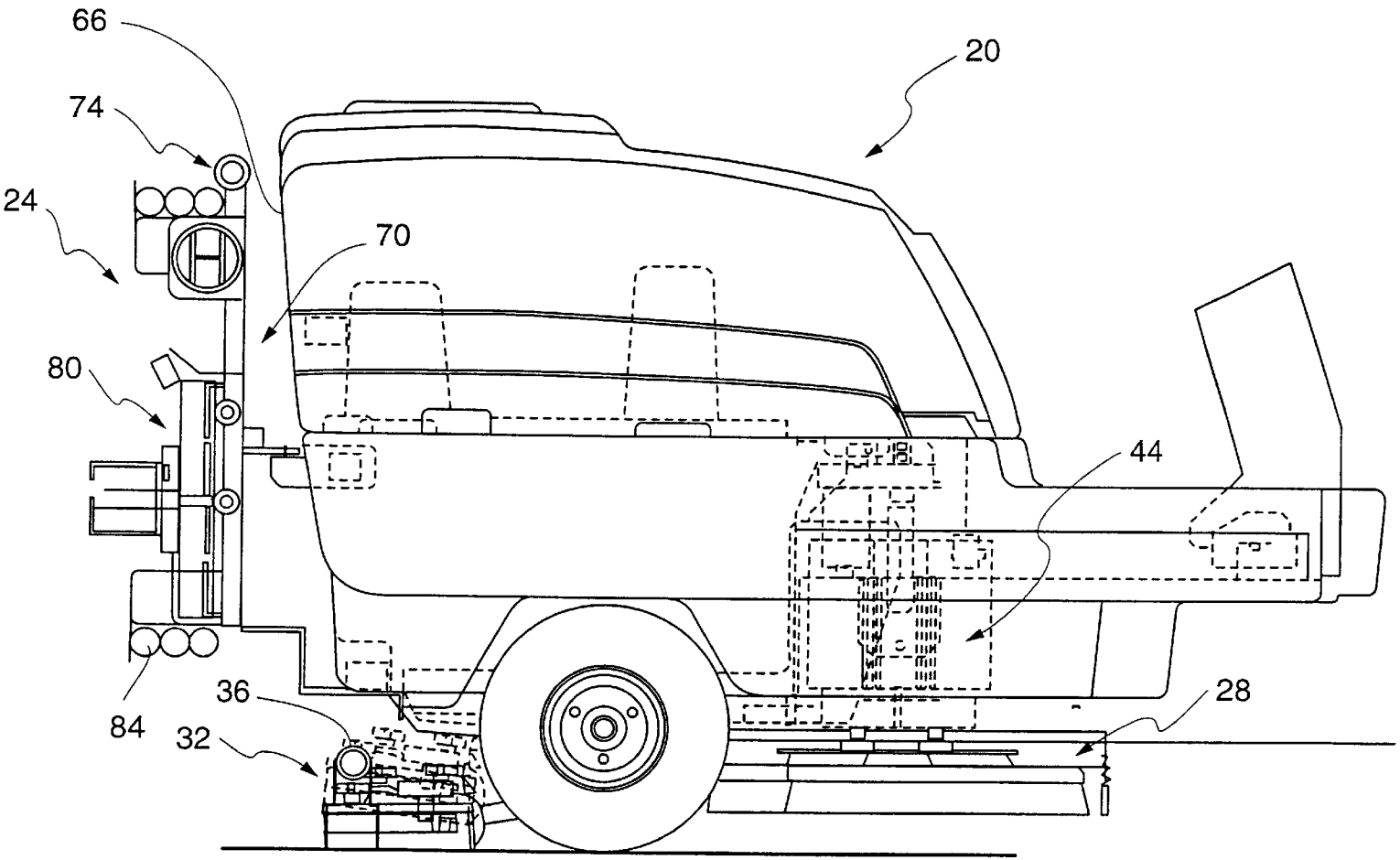
FIG. 1 illustrates a side view of substantial portions of the main scrubbing machine, with separated components of the attachment scrubbing machine held to the rear section of the main scrubbing machine.

With reference to FIG. 1, a main scrubbing machine 20 and an attachment or supplemental scrubbing machine 24 are illustrated. The main scrubbing machine 20 is shown as a rider cleaning machine, although other embodiments, such as a walk-behind cleaning machine, can be employed in the present invention. The main scrubbing machine 20 includes a first scrubber assembly 28 that is operably connected to a bottom section of the main scrubbing machine 20. The first scrubber assembly 28 is powered to rotate during the cleaning operation.

As part of the cleaning process, a main squeegee assembly 32 assists in the removal or pickup of recovered liquid from the floor area that is being cleaned. Among other components, the squeegee assembly 32 is operatively associated with a vacuum connection 36, which communicates with a negative pressure source on the main scrubbing machine 20 and that is also utilized by the attachment scrubbing machine 24, as will be noted later herein.

Figure 2:
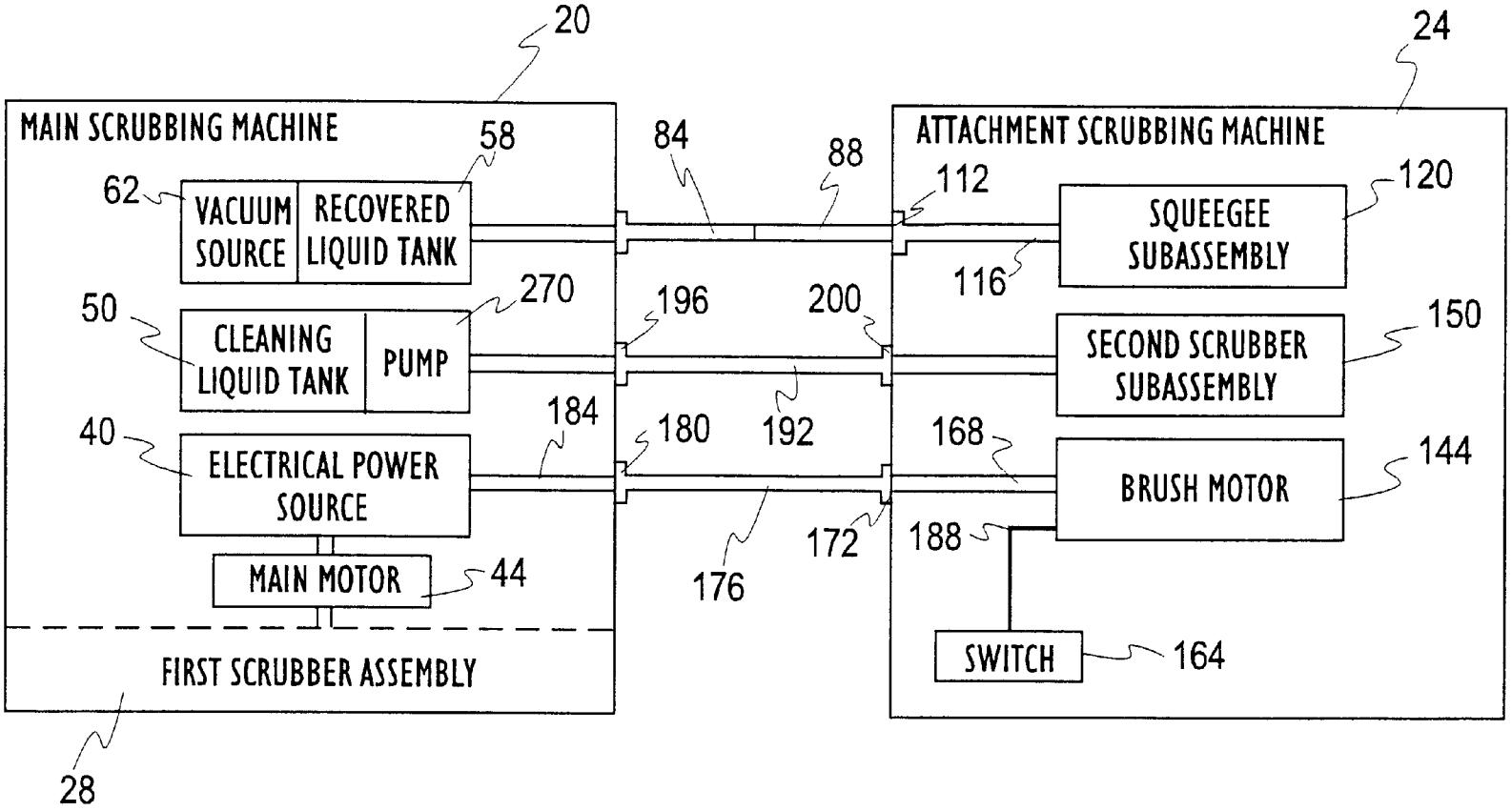
FIG. 2 is a block diagram illustrating electrical, cleaning liquid supplying and vacuum connections between the main scrubbing machine and the attachment scrubbing machine.
Figure 3:
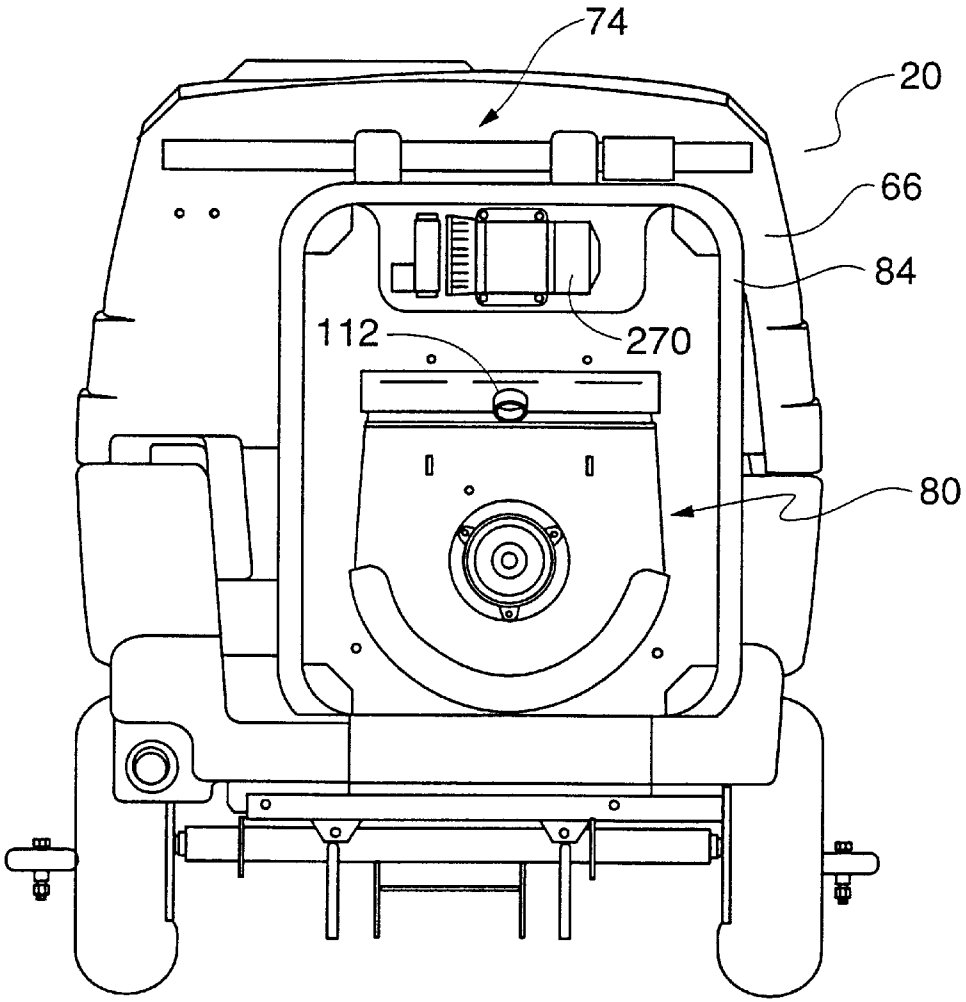
FIG. 3 represents a rear section of the main scrubbing machine with separated components, in one embodiment, of the attachment scrubbing machine being stored therewith.

In conjunction with the cleaning operation of the main scrubbing machine 20, reference is also made to FIG. 2, which schematically illustrates certain major units or components of the main scrubbing machine 20. An electrical power source 40 is electrically connected to the first scrubber assembly 28, and more particularly a main motor 44. The main motor 44 of the first scrubber assembly 28 is used to drive or cause rotational movement of scrubbing elements of the first scrubber assembly 28, such as brush bristles. In one embodiment, the electrical power source 40 includes one or more batteries.

The main scrubbing machine 20 also has a cleaning liquid tank 50 conveniently disposed for providing a cleaning liquid to the first scrubber assembly 28 that is applied to the floor area being cleaned. In one embodiment, the cleaning liquid from the cleaning liquid tank 50 is delivered to the first scrubber assembly 28 using a gravity feed. A recovered liquid tank 58 contains the liquid that is removed from the floor area at the completion of the scrubbing of that particular floor area. The recovered liquid tank 58 receives the recovered liquid through operation of a powered vacuum source 62. The vacuum source 62 is used to suction the recovered liquid into the tank 58. The vacuum source communicates with the vacuum connector 36 to draw recovered liquid that is present at the squeegee assembly 32.

In addition to the bottom section, the main scrubbing machine 20 also includes a number of other exterior housing sections including a rear section 66, as well as top and side sections. In a preferred embodiment, the rear section 66 has the attachment scrubbing machine 24 held thereto when the main scrubbing machine 20 is cleaning floor areas using the first scrubber assembly 28. More specifically, the main scrubbing machine 20 is used to clean wide floor areas, such as wide aisles that have sufficient room to allow a larger, such as a rider, cleaning machine to adequately move when cleaning such a wide surface area. On the other hand, the attachment scrubbing machine 24 is configured and of a size to allow it to scrub smaller floor areas that are commonly inaccessible to the larger main scrubbing machine 20.

As seen in FIGS. 1 and 2, the attachment scrubbing machine 24 is carried by the main scrubbing machine 20 during the cleaning of the wider or larger floor areas. The attachment scrubbing machine 24 is held to the rear section of the main scrubbing machine 20 by means of a storage rack 70. The storage rack 70 can be disconnected from the rear section 66; however, under normal usage, the storage rack 70 continuously remains with the main scrubbing machine 20. The attachment scrubbing machine 24 can be held to the storage rack 70 in separate components. The attachment scrubbing machine 24 includes a handle assembly 74 and a head assembly 80. When disassembled or separated from the head assembly 80, the handle assembly 74 is joined to the rear section 66 above the head assembly 80. Generally, the handle assembly 74 is used to receive recovered liquid from the floor area being cleaned, as well as portions of the handle assembly 74 being gripped or otherwise held by the operator when moving the attachment scrubbing machine 24. The handle assembly 74 includes a hose assembly 84 that is in operative communication with the recovered liquid tank 58, particularly when the attachment scrubbing machine 24 is drawing recovered liquid from the floor area being cleaned. As can be appreciated, the hose assembly 84 has a length that enables the attachment scrubbing machine 24 to be at an appropriate distance from the main scrubbing machine 20, while performing its cleaning operation of smaller floor surface areas.

Figure 4:
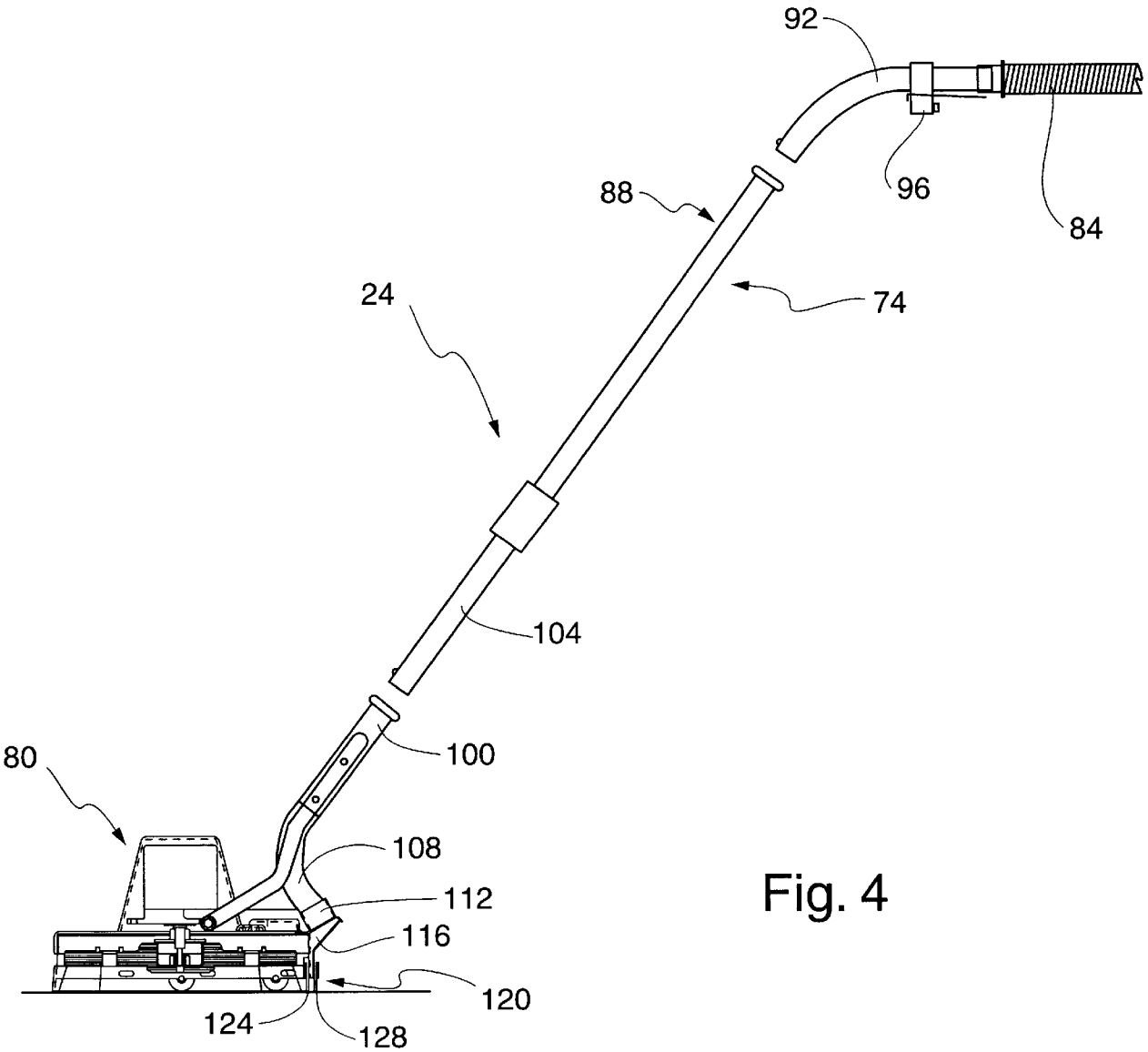
FIG. 4 illustrates a side view of the attachment scrubbing machine.

With reference to FIG. 4, the assembled attachment scrubbing machine 24 is illustrated, including the handle assembly 74 being connected to the head assembly 80. The handle assembly 74 includes a wand 88 having an upper section 92 that is joined at an end thereof to the hose assembly 84. A trigger or cleaning liquid control mechanism 96 is joined to the upper section 92. The trigger mechanism 96 is turned on/off by the operator in connection with the delivery/non-delivery of cleaning liquid to the head assembly 80. The wand 88 also has a lower section 100 that is telescopically adjustable relative to the main section 104 of the wand 88 for adjusting the overall height of the handle assembly 74. At the opposite end of the lower section 100, a short, flexible hose section 108 is joined thereto. The flexible hose section 108 is comparable to the hose assembly 84 but is substantially shorter in length. The flexible attributes of the short hose 108 enable the wand 88 to be pivoted, as will be later described herein.

With regard to the interconnection of the handle assembly 74 to the head assembly 80, the short hose 108 is joined to the head assembly 80 at a vacuum conduit 112. A vacuum chamber 116 engages the vacuum conduit 112 and directly communicates with a squeegee subassembly 120. The squeegee subassembly 120 includes a pair of spaced first and second squeegee members 124, 128. The space or gap between the squeegee members 124, 128 communicates with the vacuum chamber 116. Accordingly, the vacuum for drawing recovered liquid from the floor area being cleaned is communicated through the handle assembly 74 to the squeegee subassembly 120 by means of the vacuum conduit 112 and vacuum chamber 116.

Figure 5:
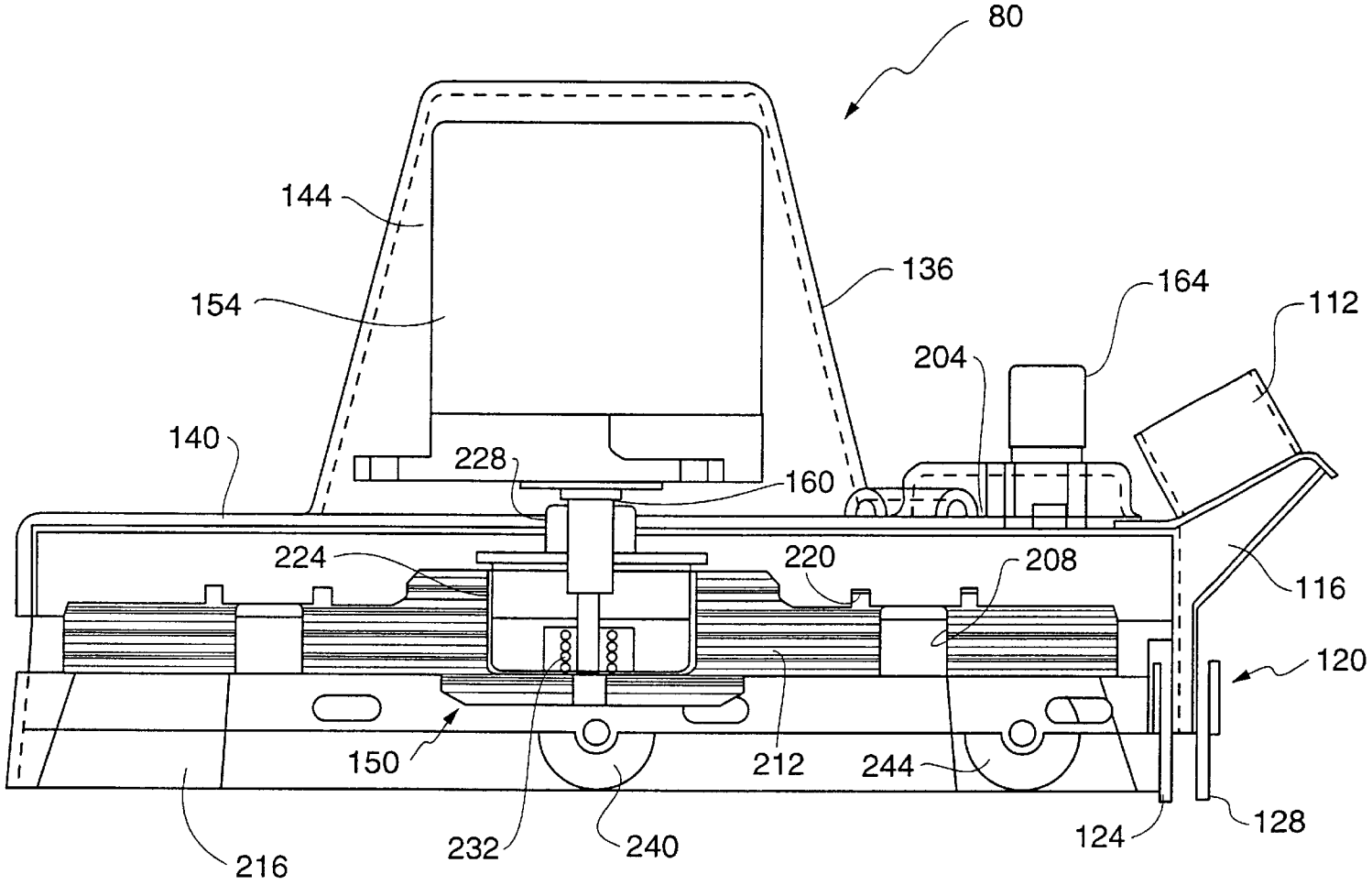
FIG. 5 illustrates a cross-sectional view of the head assembly of the attachment scrubbing machine.

With reference to FIG. 5 as well, the head assembly includes a head or cover 136 that has a lower end, which is joined to a deck 140. A brush motor 144 is used to power or drive a second or attachment scrubber assembly 150 and has substantial portions housed within the head 136 including a motor body 154. A brush motor shaft 160 extends from the bottom of the motor body 154 and rotates when the brush motor 144 is powered or activated. Rotational movement of the motor shaft 160 causes rotational movement of the second scrubber assembly 150. The head assembly 80 also includes a motor switch 164 that is used to turn on/off the brush motor 144 and thereby initiate/stop rotation of the second scrubber assembly 150. Preferably, the switch 164 is foot activated by the operator of the attachment scrubbing machine 24.

With reference to FIG. 2 also, the brush motor 144 has brush motor conducting wires 168 that are electrically connectable to first electrical connector unit or plug 172. The first electrical connector unit 172 receives an electrical cord 176 having a number of insulated electrical conducting lines or wires. At the opposite end of the electrical cord 176, a second electrical connector unit 180 is connectable at the main scrubbing machine 20 to receive conducting wires 184 from the electrical power source 40, such as the battery terminals. As can be appreciated in assembling the attachment scrubbing machine 24, after removal from the main scrubbing machine 20, the electrical cord 176 and the first electrical connector unit 172 are positioned so that the first electrical connector unit 172 can be connected to the attachment scrubbing machine 24 at its electrical inlet or socket. Alternatively, the electrical cord 176 could be provided so that it is essentially always electrically connected to the brush motor conducting wires 168. As also seen in FIG. 2, the motor switch 164 has one or more switch conductors 188 that electrically communicate with the brush motor 144 for controlling the application of power from the electrical power source 40 through the electrical communication path to the brush motor 144. Alternatively, the electrical communication to the brush motor 144 by the switch 164 could be by way of an electrical connection with the brush motor conducting wires 168.

As also schematically represented in FIG. 2, a cleaning liquid supply line 192 acts as a carrier or conduit for cleaning liquid from the cleaning liquid tank 50 of the main scrubbing machine 20 to the attachment scrubbing machine 24. More particularly, first and second cleaning liquid connectors 196, 200 are used in providing the desired fluid communication between the main scrubbing machine 20 and the attachment scrubbing machine 24 for the cleaning liquid that is delivered to the second scrubber assembly 150. Preferably, the cleaning liquid supply line 192 is disposed outwardly, but adjacent to, the wand 88. Likewise, the electrical cord 176 is located outwardly of the wand 88 as it is positioned for electrical connection to the brush motor 144. In another embodiment, the cleaning liquid is housed in a tank that is part of the attachment scrubbing machine so that cleaning liquid need not be obtained from the main scrubbing machine.

As seen in FIG. 5, a cleaning liquid inlet or receptacle 204 is joinable to the cleaning liquid supply line 192. Cleaning liquid exits the inlet 204 to be received in a circular or oval-shaped opening 208 in a plate or support member 212 of the second scrubber assembly 150. With continued reference to FIG. 5, the cleaning liquid that exits the inlet 204 is subsequently received by the opening 208, where it passes therethrough and contacts the floor or surface area being cleaned by the second scrubber assembly 150. As understood from FIG. 5, the cleaning liquid escapes the opening 208 within the boundary or confines of the brush member or brush bristles 216 that rotate and contact the floor area being cleaned during operation. Consequently, advantageous placement of the cleaning liquid is achieved for ensuring proper contact thereof with the brush bristles 216.

The support member 212 includes a ridge member 220 that follows the contour of the circular or oval-shaped opening 208. When cleaning liquid is input to the opening 208, the ridge member 220 acts as a guide or barrier to funnel or otherwise ensure that the cleaning liquid passes into the opening 208. In substantially the center of the support member 212, a cavity 224 is formed. Above the cavity 224, a drive lug 228 is connected to the motor drive shaft 160. The drive lug 228 is part of the driven mechanism of the second scrubber assembly 150 for transferring the rotational motion of the motor shaft 160 to the support member 212.

Figure 6:
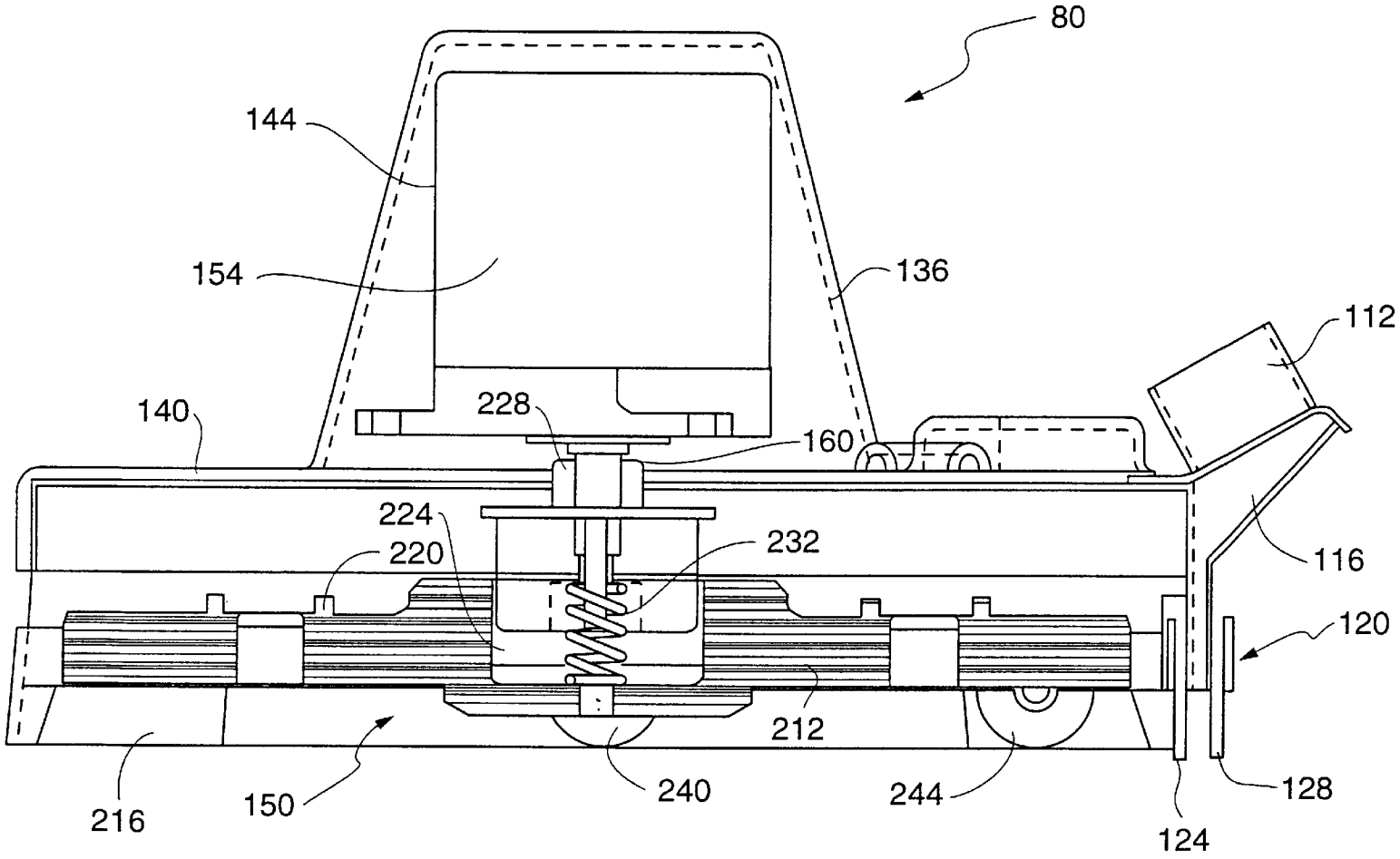
FIG. 6 illustrates a cross-sectional view of the head assembly of the attachment scrubbing machine with the spring for controlling position of brush bristles being relatively more extended due to brush bristle wear.

The scrubber assembly 150 also includes a brush adjustment mechanism that preferably includes a spring 232 that is operably connected to the bottom of the support member 212. The spring 232 is used in regulating the position of the lower or free ends of the brush bristles 216 relative to the floor being cleaned. As illustrated in FIG. 5, when the lengths of the brush bristles 216 are new or have been subject to only minor wear, the spring 232 is in a first or substantially compressed state. As the brush bristles 216 wear, the support member 212 is automatically caused to move in a downward direction towards the floor due to the action of the spring 232, thereby also forcing the brush bristles 216 against the floor. That is, as illustrated in FIG. 6, the spring 232 extends as the brush bristles 216 wear so that desired constant and uniform contact is maintained between the free ends thereof and the surface being cleaned.

Accordingly, by means of the compression spring 232 located essentially between the top of the brush bristles 216 and the bottom of the drive lug 228, any need to adjust the brush bristles 216 for wear is eliminated. There is 0.625 inch of bristle wear before the brush bristles 216 are considered to be worn out. The head assembly weighs approximately 20 pounds. The compression value of the spring 232 is 11.5 lbs/inch. Its free length is 1.5 inch. When the brush bristles 216 are new, the spring collapses approximately 1.1 inch, yielding approximately 12.7 lbs of pressure to the brush bristles 216. When the brush bristles 216 are essentially worn out, the spring 232 collapses 0.48 inch, yielding 5.5 lbs. of pressure to the brush bristles 216. Hence, the brush bristles 216 always have a positive pressure against the floor. With respect to the drive lug 228, it is preferably triangular shaped and made of aluminum that engages a slightly oversized triangular relief in the top of the support member 212. This oversizing gives the support member 212 the ability to gimbal or tilt in order to properly respond to any unevenness in the floor plane. Since a triangle engagement is used, instead of a hexagonal or octagonal engagement, the resistance to becoming disengaged or to strip is greatly enhanced.

The head assembly 80 also includes spaced wheels 240, 244. Preferably, each of the wheels 240, 244 is part of a pair of spaced wheels. The first pair of spaced wheels 240 is centrally located relative to the second scrubber assembly 150, with such wheels being located on opposite sides of the width of the head assembly 80. Similarly, the second pair of wheels 244 has the two wheels on opposite sides of the width of the head assembly 80. The wheels 244 are adjacent to the squeegee subassembly 120. These four relatively small wheels 240, 244 provide a controlled plane of contact between the area being cleaned and the brush bristles 216 and between the floor area being cleaned and the squeegee subassembly 120. Because such wheels 240, 244 spaced along the length of the head assembly 80 are utilized, pitching forward of the head assembly 80 or back pivoting around the axles of the wheels 240, 244 are avoided. Thus optimum contact between the first and second squeegee members 124, 128 and the floor is not subject to compromise due to such pitching action. Relatedly, since the four wheels 240, 244 are fixed in place, a permanently fixed distance is created between the deck 140 and the floor. The replaceable rubber strips or first and second squeegee members 124, 128 can be attached by holes in the rubber to holes in the wall of the head assembly 80. This results in only replacement of worn-out first and second squeegee members 124, 128, instead of constant readjustment.

Figure 7:
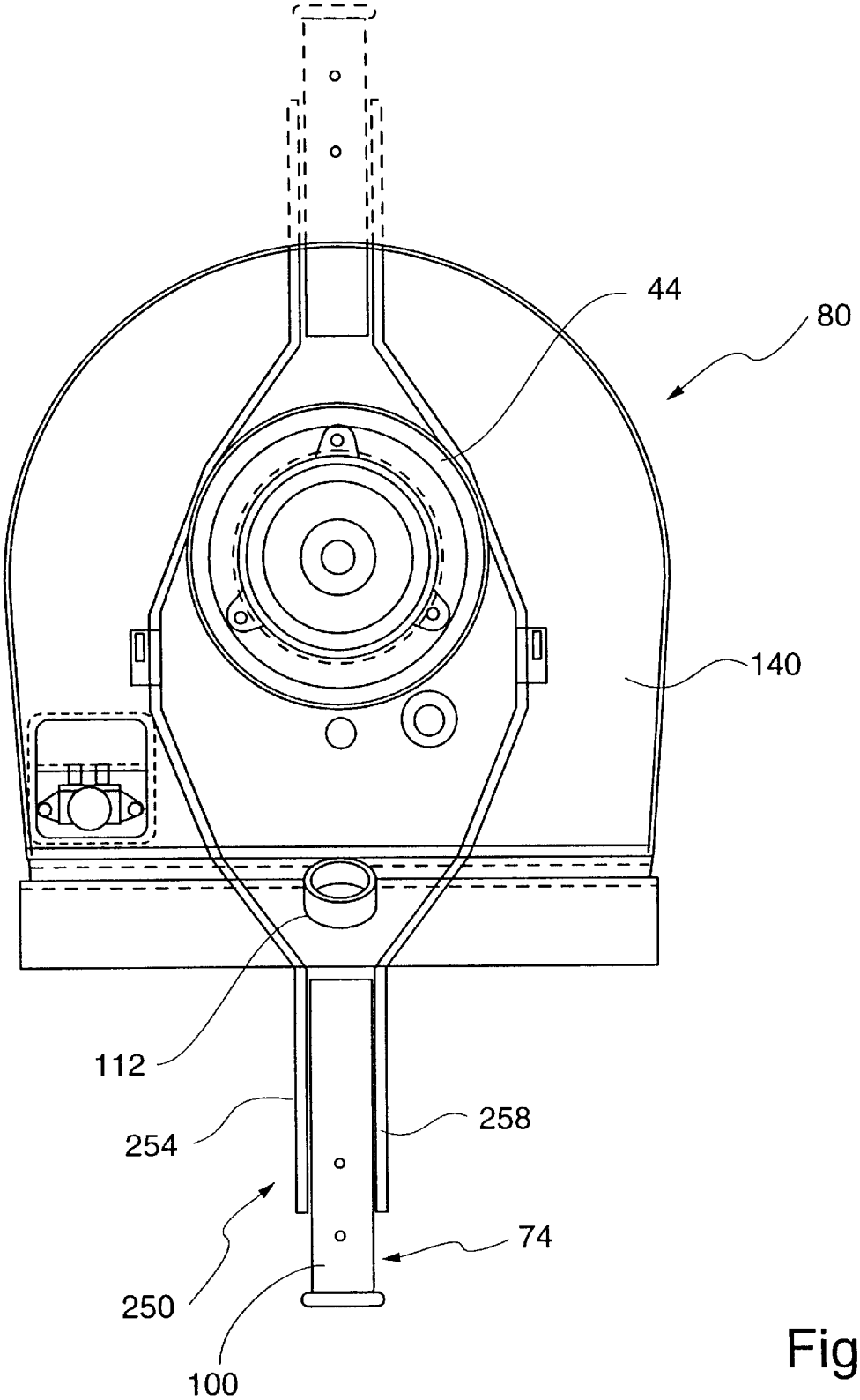
FIG. 7 illustrates a top view of the head assembly with the lower end of the wand being connected thereto.
Figure 8:
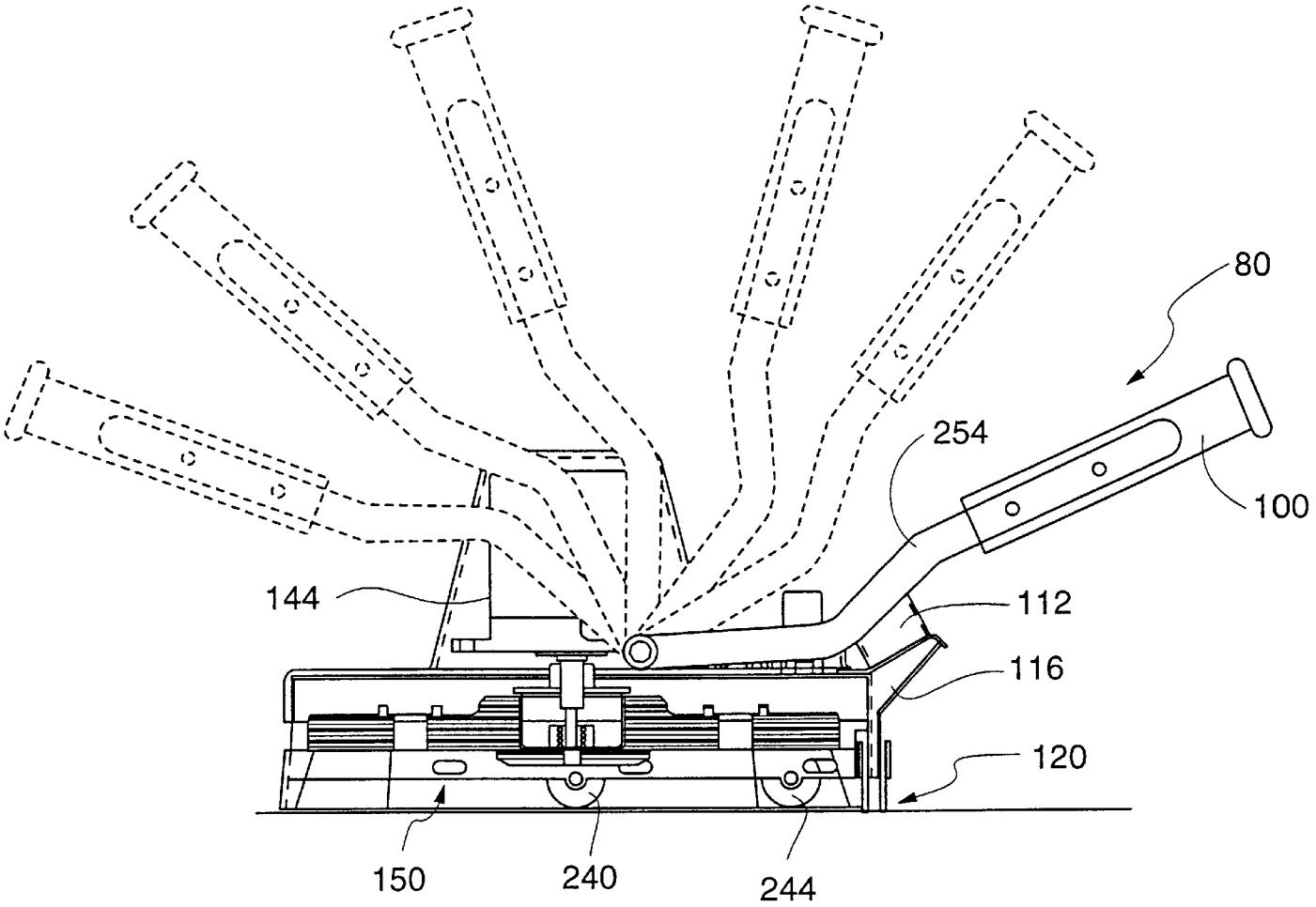
FIG. 8 illustrates pivoting the yoke member with the lower section of the wand relative to the brush motor and head.

With reference to FIG. 7 and 8, the handle assembly 74 also includes a yoke member 250 having a pair of arms 254, 258 that are pivotally connected to other portions of the handle assembly 74. At their opposite ends, the arms 254, 258 are connected to opposing parts of the lower section 100 of the wand 88. The arms 254, 258 diverge from the lower section 100 to opposite sides of the head 136. This pivotal connection enables the handle assembly 74 to be pivoted about an axis defined through the connections of the arms 254, 258 to the handle assembly 80. Such pivoting allows the handle assembly 74 to be located at a number of positions relative to the head assembly 80 including positioned at an opposing end from the squeegee subassembly 120. This affords the operator the ability to use the attachment scrubbing machine 24 with the squeegee subassembly on a side that is located farthest from the operator. This is especially useful when scrubbing into blind corners where a significant amount of water (12-inch area) would be left standing, if not for the ability to pivot the handle assembly 74 in such a manner. optionally, if the operator preferred this configuration in which the squeegee subassembly 120 is located farthest from the operator, additional holes in the wand 88 allow for proper orientation for such a position.

With regard to a further description related to the operation of the combination main scrubbing machine 20 and attachment scrubbing machine 24, assume that the main scrubbing machine 20 has completed scrubbing a larger floor area and the first scrubber assembly 28 cannot access a smaller floor area adjacent to the larger floor area that was just scrubbed. In order to clean this smaller area, the main scrubbing machine 20 is stopped, the brake thereof is engaged, while the key switch remains on. The head assembly 80 is removed from the storage rack 70 and placed on the floor. The handle assembly 74 including the wand 88 is removed from the storage rack 70 and the short, flexible hose 108 is joined to the vacuum conduit 112 on the attachment scrubbing machine 24. The first electrical connector unit 172 is electrically connected to the electrical inlet or socket on the head assembly 80. The cleaning liquid supply line having the second cleaning liquid connector 200 is joined to the receptacle 204 on the deck 140. The hose assembly 84 is uncoiled to a length, as needed, from the storage rack 70. The vacuum hose of the main scrubbing machine 20 is disconnected from the main squeegee assembly 32 of the main scrubbing machine 20. The proper end of the hose assembly 84 is then connected to the main scrubbing machine squeegee assembly or a vacuum hose connected thereto. A cleaning liquid pump 270 held to the rear section 66 of the main scrubbing machine 20 can be turned on by activating a switch on the storage rack 70 for the pump mechanism 270. The vacuum motor or motors are also powered on by using a switch on a control panel of the main scrubbing machine 20. The wand 88 can be telescopically adjusted for a particular height and/or different angles thereof. If desired or appropriate, the handle assembly 74 can also be pivoted to a suitable position. The brush motor 144 is activated by pressing the switch 164 using the operator's foot. The second scrubber assembly 150 rotates and the operator activates the trigger mechanism 96 on the upper section 92 of the handle assembly 74 to enable the cleaning liquid to be carried through the cleaning liquid supply line 192, through the cleaning liquid receptacle 204, and then through the opening 208 in the support member 212 of the second scrubber assembly 150.

After cleaning the smaller floor area, the trigger mechanism 96 is deactivated, but the operator continues to use the attachment scrubbing machine 24 to pick up recovered liquid from the smaller floor area using the squeegee subassembly 120. Once this is finished, the brush motor 144 is powered off, as well as the motor of the pump mechanism 270 and the vacuum motor or motors on the main scrubbing machine 20. The attachment scrubbing machine 24 can be re-attached to the rear section 66 of the main scrubbing machine 20 by first disassembly of the attachment scrubbing machine 24 in essentially a reverse order of the steps taken in preparing the attachment scrubbing machine 24 to scrub the smaller floor area.

Figure 9:
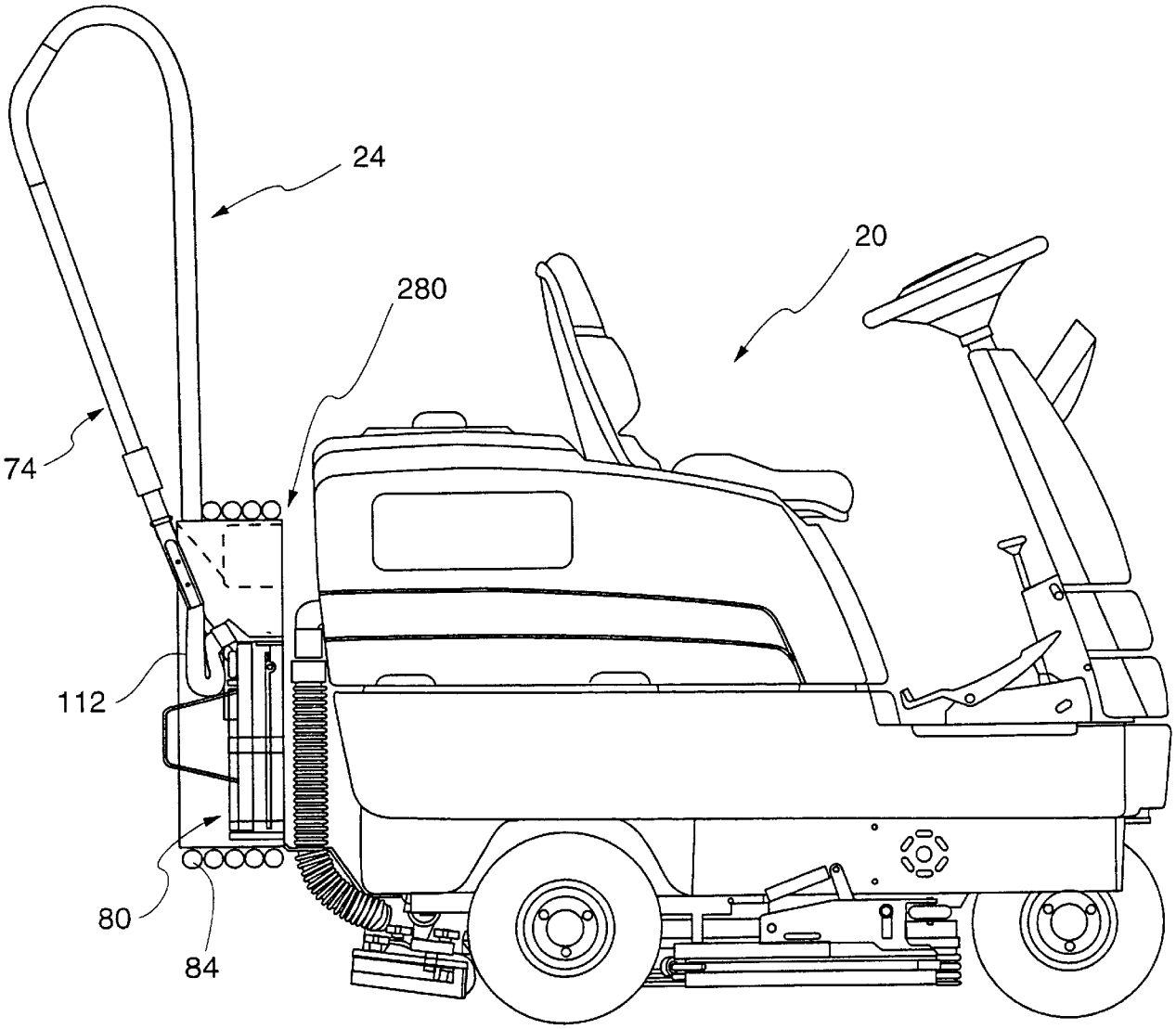
FIG. 9 illustrates a side view of another embodiment of the combination main scrubbing machine and attachment scrubbing machine in which the attachment scrubbing machine is held to the storage rack of the main scrubbing machine in an assembled state.
Figure 10:
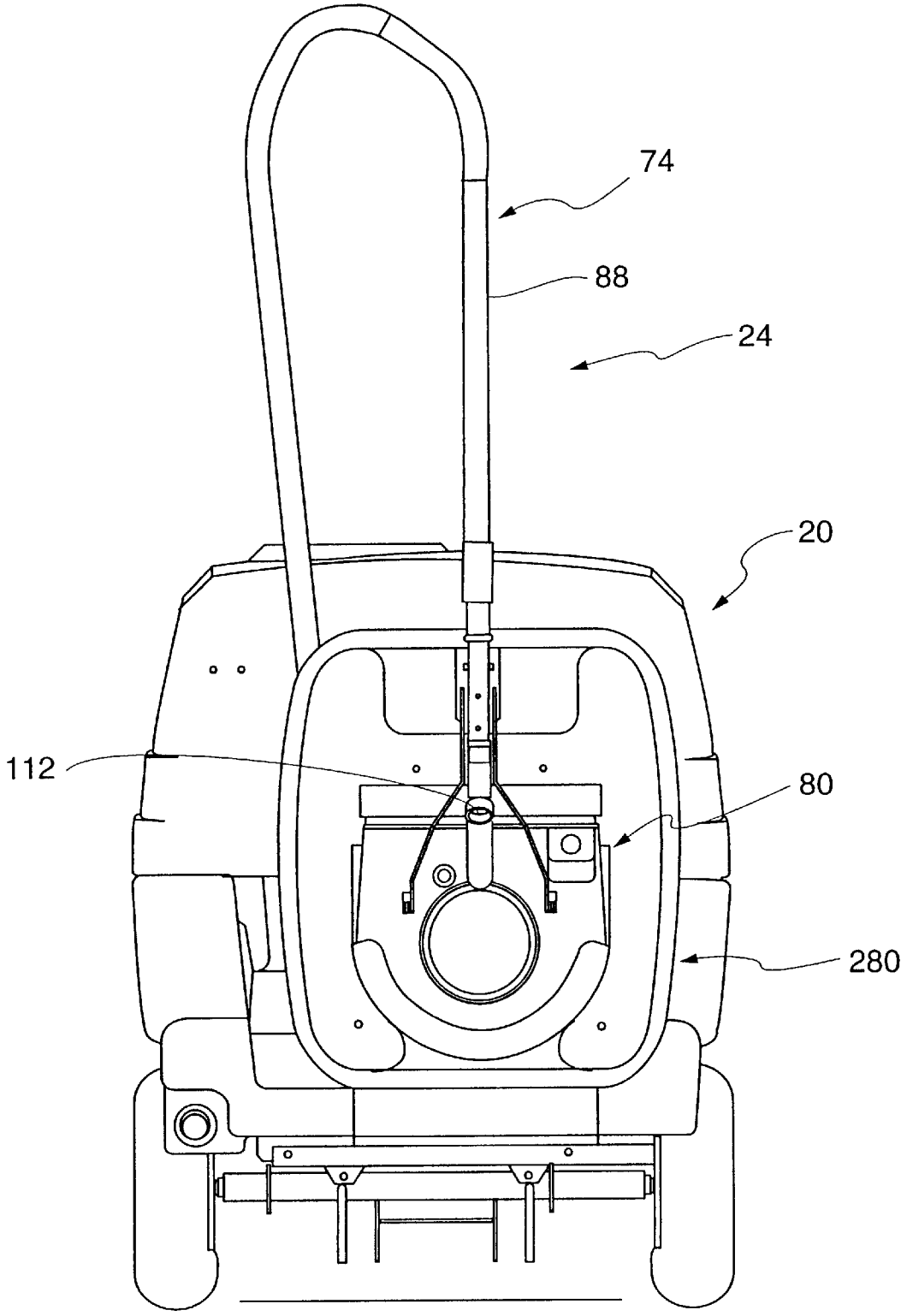
FIG. 10 illustrates a rear view of the embodiment of FIG. 9.

With reference to FIGS. 9 and 10, an embodiment for holding the attachment scrubbing machine 24 to the main scrubbing machine 20 without disassembly of the handle assembly 74 from the head assembly 80 is seen. As illustrated, the handle assembly 74 remains operatively connected to the head assembly 80 when held to the rear of the main scrubbing machine 20. The short flexible hose 108 remains connected to the vacuum conduit 112. The cleaning liquid supply line 192 remains connected to the attachment scrubbing machine 24. The electrical cord 176 and the first electrical connector unit 172 remain electrically and operably connected to the attachment scrubbing machine 24, particularly the motor wires 168. This holding or otherwise supporting of the attachment scrubbing machine 24 in its assembled condition to the main scrubbing machine 20 is accomplished using a storage unit 280. The storage unit 280 is configured using one or more sections, components thereof and/or fasteners connected thereto for receiving and maintaining at least portions of the attachment scrubbing machine 24 in the supportive position at the rear of the main scrubbing machine 20.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiments described hereinabove are further intended to explain the best mode presently known of practicing the invention and to enable others skilled in the art to utilize the invention as such, or in other embodiments, and with the various modifications required by the particular application or uses of the invention. It is intended that the appended claims be construed to include alternative embodiments to the extent permitted by the prior art.

What is claimed is:

1. A combination of two scrubbing machines that are different from each other, comprising:

a main scrubbing machine having a number of machine sections including a first machine section, said main scrubbing machine including a powered first scrubber assembly, a source of electrical power, a vacuum source, liquid recovery means and cleaning liquid means; and an attachment scrubbing machine including a head assembly and a handle assembly, said head assembly including a powered second scrubber assembly, a head with a motor for powering said second scrubber assembly, a vacuum conduit, squeegee means and a number of wheels;

wherein said attachment scrubbing machine is removably secured to said main scrubbing machine, such that when said main scrubbing machine is cleaning a first floor area said attachment scrubbing machine is secured thereto and said attachment scrubbing machine is removed from said main scrubbing machine when said attachment scrubbing machine is cleaning a second floor area having a different size than said first floor area.

2. A combination, as claimed in claim 1, wherein:

said attachment scrubbing machine includes first means for electrically connecting said motor to said source of electrical power of said main scrubbing machine.

3. A combination, as claimed in claim 2, wherein:

said first means includes a first electrical connector and said head assembly has an electrical connection to which said first electrical connector is joined.

4. A combination, as claimed in claim 2, wherein:

said first means includes a switch secured to said head assembly, said switch for controlling application of electrical power to said motor.

5. A combination, as claimed in claim 3, wherein:

said first means includes a second electrical connector located at said first machine section of said main scrubbing machine.

6. A combination, as claimed in claim 5, wherein:

said first means includes an electrical power line joined to said first and second electrical connectors and disposed outwardly of at least portions of said handle assembly.

7. A combination, as claimed in claim 1, wherein:

said cleaning liquid means supplies cleaning liquid to said attachment scrubbing machine.

8. A combination, as claimed in claim 1, wherein:

said cleaning liquid means includes a cleaning liquid supply line located outwardly of at least portions of said handle assembly and extending to said main scrubbing machine.

9. A combination, as claimed in claim 8, wherein:

said cleaning liquid supply line includes an inlet receptacle joined to said head assembly wherein cleaning liquid is received within an interior of said second scrubber assembly.

10. A combination, as claimed in claim 1, wherein:

said head assembly includes a deck and said head is located about said motor on top of said deck.

11. A combination, as claimed in claim 1, wherein:

said handle assembly includes a wand and a yoke joined to said wand and in which said wand and said yoke are pivotal over said motor.

12. A combination, as claimed in claim 11, wherein: said wand includes a flexible hose connected to said vacuum conduit.

13. A combination, as claimed in claim 1, wherein:

said handle assembly includes a telescoping wand for carrying recovered liquid from the second floor area while being free of electrical power and cleaning liquid supply lines.

14. A combination, as claimed in claim 1, wherein:

said second scrubber assembly includes a support member and brush bristles disposed along a periphery of said support member and said second scrubber assembly includes a drive lug operatively connected to said motor and bias means disposed below said drive lug.

15. A combination, as claimed in claim 14, wherein:

said bias means includes a spring connected at one end to a bottom of said support member that expands in a substantially vertical direction as said brush bristles wear.

16. A combination, as claimed in claim 1, wherein:

said second scrubber assembly includes a support member and brush bristles connected thereto, with at least one opening provided in said support member for receiving cleaning liquid.

17. A combination, as claimed in claim 16, wherein:

said support member includes a raised rim for guiding cleaning liquid into said at least one opening.

18. A combination, as claimed in claim 1, wherein:

said number of wheels includes at least three wheels, with at least two of said wheels spaced from each other in a direction away from said squeegee means.

19. A combination, as claimed in claim 1, wherein:

said number of wheels includes at least four wheels, with two of said wheels adjacent said squeegee means and two of said wheels adjacent a center of said second scrubber assembly.

20. A combination, as claimed in claim 1, wherein:

said squeegee means is fixed in position such that a bottom free edge of said squeegee means remains at substantially the same relative position to a floor area being cleaned regardless of length of brush bristles of said second scrubber assembly.

21. A combination, as claimed in claim 1, wherein:

said handle assembly remains operably connected to said head assembly when said attachment scrubbing machine is joined to said main scrubbing machine including one or more of the following connections: an electrical connection between said main scrubbing machine and said attachment scrubbing machine, a vacuum connection between said main scrubbing machine and said attachment scrubbing machine and a cleaning liquid supply connection between said main scrubbing machine and said attachment scrubbing machine.

22. A method for cleaning floor areas using a combination of two different scrubbing machines, comprising:

securing an attachment scrubbing machine to a main scrubbing machine, said main scrubbing machine including a powered first scrubber assembly, said attachment scrubbing machine including a handle assembly and a head assembly that includes a motor and a powered second scrubber assembly;

cleaning firstly a first floor area using said main scrubbing machine after said securing step;

discontinuing cleaning of said first floor area;

removing said attachment scrubbing machine from said main scrubbing machine;

switching on power to said motor of said attachment scrubbing machine wherein said second scrubber assembly moves using power applied thereto; and cleaning secondly a second floor area having a different size than said first floor area using said second scrubber assembly of said attachment scrubbing machine.

23. A method, as claimed in claim 22, further comprising:

assembling said attachment scrubbing machine including interconnecting said head assembly and said handle assembly after said removing step for use in conducting said secondly cleaning step.

24. A method, as claimed in claim 22, further including:

associating a cleaning liquid supply line with said head assembly.

25. A method, as claimed in claim 24, wherein:

said associating step includes disposing at least portions of said cleaning liquid supply line outwardly of said handle assembly.

26. A method, as claimed in claim 24, wherein:

said associating step includes positioning said cleaning liquid supply line such that cleaning liquid is received interiorly of said second scrubber assembly.

27. A method, as claimed in claim 22, wherein:

a power line is connected to said motor and at least portions of said power line are disposed outwardly of said handle assembly.

28. A method, as claimed in claim 22, wherein:

said switching step includes providing a switch on said head assembly.

29. A method, as claimed in claim 22, wherein:

said cleaning secondly step includes picking up recovered liquid using a squeegee means that is continuously, fixedly held in position regardless of brush bristle wear of said second scrubber assembly.

30. A method, as claimed in claim 22, wherein:

said second scrubber assembly includes brush bristles that wear and said method further includes biasing said second scrubber assembly using a spring such that, as said brush bristles wear, bottom free ends thereof are maintained in a desired position relative to floor areas to be cleaned.

31. A method, as claimed in claim 22, wherein:

said cleaning secondly step includes supporting said head assembly using two pairs of wheels, with said first pair being located adjacent the center of said head assembly and said second pair being located adjacent an end of said head assembly.

32. A method, as claimed in claim 22, further including:

pivoting said handle assembly over said motor in order to change a position of at least portions of said handle assembly relative to a squeegee means of said head assembly.

33. A method, as claimed in claim 22, further including:

adjusting a length of a wand of said handle assembly and in which said wand is free of electrical power and cleaning liquid supply lines.

* * * * *